US005342135A

United States Patent [19]

Tucker

[11] Patent Number: 5,342,135

[45] Date of Patent: Aug. 30, 1994

[54] WRITING INSTRUMENT HAVING ADVANCE-RETRACT MECHANISM

[75] Inventor: William E. Tucker, Attleboro, Mass.

[73] Assignee: The Gillette Company, Boston, Mass.

[21] Appl. No.: 107,519

[22] Filed: Aug. 17, 1993

[51] Int. Cl.[5] ..... B43K 24/06

[52] U.S. Cl. ..... 401/116; 401/110; 401/33

[58] Field of Search ..... 401/109–112, 401/116, 30, 32, 33, 75, 76, 68

[56] References Cited

U.S. PATENT DOCUMENTS

| | | | |
|---|---|---|---|
| 3,679,318 | 7/1972 | Liguori | 401/110 |
| 3,792,931 | 2/1974 | Ganz | 401/109 |
| 4,022,535 | 5/1977 | Ritter | 401/32 |
| 4,290,707 | 9/1981 | Ariga | 401/110 |
| 4,580,918 | 4/1986 | Baker et al. | 401/109 X |
| 4,786,197 | 11/1988 | Koeln et al. | 401/116 |
| 5,092,701 | 3/1992 | Lai | 401/109 X |

FOREIGN PATENT DOCUMENTS

| | | | |
|---|---|---|---|
| 1004813 | 4/1952 | France | 401/116 |
| 541593 | 4/1956 | Italy | 401/116 |
| 370332 | 8/1963 | Switzerland | 401/116 |
| 934160 | 8/1963 | United Kingdom . | |

*Primary Examiner*—Danton D. DeMille

*Attorney, Agent, or Firm*—Own J. Meegan; Aubrey C. Brine; Donal B. Tobin

[57] ABSTRACT

A writing instrument includes an advance-retract mechanism for projecting the writing tip from within the barrel for employment of the writing instrument, and retracting the tip to a point within the barrel, when the writing instrument is not in use. A plunger assembly includes a rotatable knob which is disposed at the top of the barrel and is interconnected to a finger which contacts the cam surface of a slidable actuator. Rotation of the knob in one direction advances the writing tip from within the barrel and opposite rotation of the knob is effective to retract the writing tip into the barrel.

21 Claims, 5 Drawing Sheets

WRITING INSTRUMENT HAVING ADVANCE-RETRACT MECHANISM

BACKGROUND OF THE INVENTION

The present invention relates to writing instruments and more particularly to a writing instrument having a mechanism for advancing the writing tip of the instrument from the instrument barrel for employment of the writing instrument and retracting the writing tip to a point within the barrel when the instrument is not in use.

Various writing instruments, such as pencils or ball point pens, are known in which the writing tip is advanced or retracted relative to the barrel by means of rotating or pushing the external elements on the barrel of the instrument. Typical of these advance-retract devices are U.S. Pat. No. 3,679,318, issued Jul. 25, 1972, to Thomas A. Liguori; U.S. Pat. No. 4,290,707, issued Sept. 22, 1981, to Tatsuo Ariga; U.S. Pat. No. 4,786,197, issued Nov. 22, 1988, to Harold E. Koeln et al.; French patent 1004813, published Apr. 3, 1952, in the name of Poursier; and British patent specification 934160, published Aug. 14, 1963, in the name of Ronald Hare. These and other such devices have been disclosed, and a wide variety of devices of this type have been produced and met with commercial success.

It has been found that many of these devices require in their assembly a variety of fastening elements such as threaded screws, rivets or the like to complete the assembly. The employment of threaded elements, rivets, etc. effectively increases the cost of the writing instrument both from a standpoint of materials as well as labor, during assembly.

In view of the foregoing therefore it is an object of the invention to provide a writing instrument having an advance-retract mechanism containing a minimal number of parts which may be inexpensively produced.

A further object of the invention is to provide a writing instrument having an advance-retract mechanism which is simple in construction and more easily and economically assembled than those of the prior art.

Yet another object of the invention is to provide a writing instrument which is economical to produce, efficient in operation and easily adaptable to mass production techniques.

SUMMARY OF THE INVENTION

The above objects and other objectives which will become apparent as the description proceeds are accomplished by providing a writing instrument comprising a cylindrical barrel member having a front opening, an elongated writing assembly having a writing tip at the forward end thereof adjacent the front opening in the barrel, and a plunger assembly. The plunger assembly comprises a rotatable knob disposed adjacent the outer surface of the rear wall of the barrel and an elongated drive portion extending into the barrel. A ring is disposed on the elongated drive portion adjacent the inner surface of the barrel rear wall and is retained against axial movement along the drive portion, the ring further having a forwardly facing surface that is rotatable by rotation of the knob. A slidable actuator is disposed within the barrel having a forward facing surface contacting the writing assembly and a rearwardly facing cam surface contacting the ring rotatable surface. Rotation of the knob is effective to move the actuator element axially and thereby move the writing tip to a point outside the barrel front opening and maintain it there during use, and reverse rotation is effective to retract the tip to a point inside the barrel front opening, when the writing instrument is not in use.

The forwardly facing rotatable surface is generally disposed on a forwardly projecting finger provided on the ring, and the ring is retained against axial movement along the plunger assembly drive portion by providing a circular groove formed on the outer surface of the drive portion and an inner surface of the ring for interfitting engagement within the groove.

The knob has a forwardly facing surface disposed adjacent the barrel rear wall and the ring is provided with a rearwardly facing surface contacting the rear wall with the ring engaged in the drive portion groove. The knob forwardly facing surface and the ring rearwardly facing surface are spaced from one another to clamp the wall therebetween and thereby inhibit axial movement of the knob and ring assembly with the ring inner surface engaged in the groove.

The writing instrument may further include a clip having a portion extending along the barrel and another portion extending over the barrel rear wall in which instance the elongated drive portion extends through an opening formed in the clip portion.

The elongated drive portion generally has an axially disposed keyway formed on its outer surface and the forwardly extending finger has an inwardly projecting key formed thereon, the key being disposed in the keyway to cause rotation of the finger during rotation of the drive portion. Further, the slidable actuator is provided with means for inhibiting rotation thereof and maintain the writing tip in the extended position which may take the form of a notch formed in the cam surface of the slidable actuator into which the forwardly extending finger is received.

The slidable actuator further is provided with a plurality of axially disposed outwardly projecting slide bars which are received in a plurality of axial grooves formed in the barrel to inhibit rotation of the slidable actuator.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
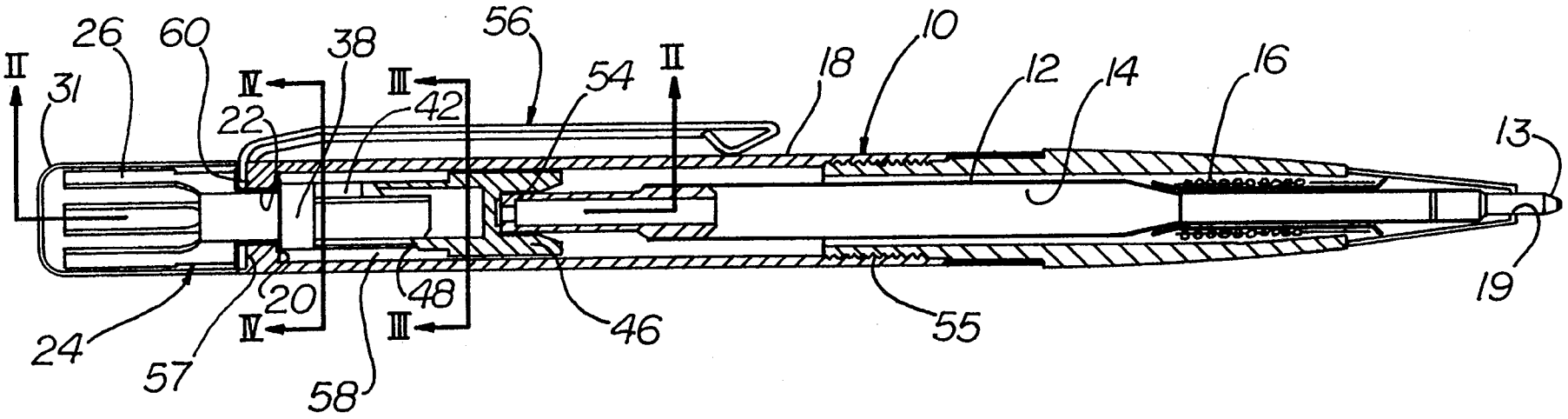
FIG. 1 is a sectional elevational view showing a writing instrument constructed in accordance with the teachings of the present invention.
Figure 2:
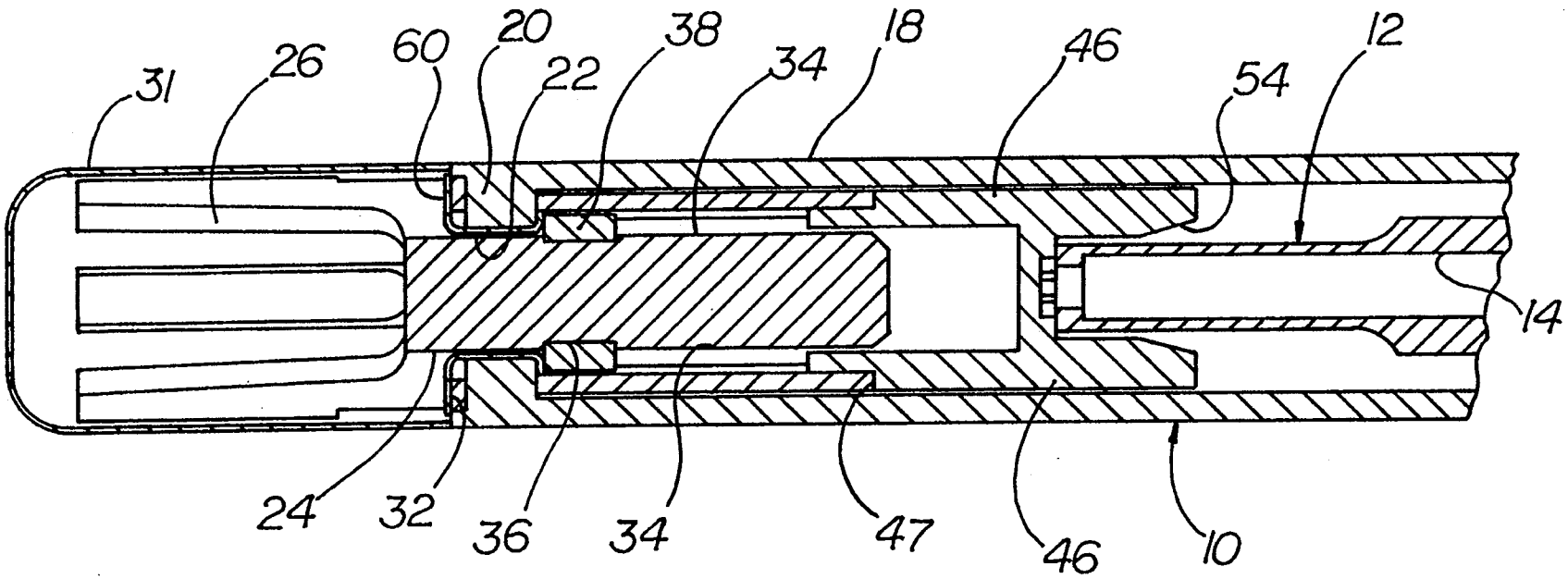
FIG. 2 is a sectional plan view taken along the line II—II of FIG. 1, taken on an enlarged scale for clarity showing details of the structure of FIG. 1.

Referring now to the drawing, there is shown a writing instrument 10 in the form of a ball point pen having an elongated writing assembly 12 which in the present embodiment is a ball point pen cartridge having a writing tip 13 and an ink reservoir 14, the writing assembly being biased in the rearward direction by a helical spring 16. The writing instrument 10, further comprises a barrel 18 having a front opening 19 through which the writing tip 13 is extended and retracted, and a rear wall 20 having an opening 22 formed for receiving a plunger assembly 24.

Figure 5:
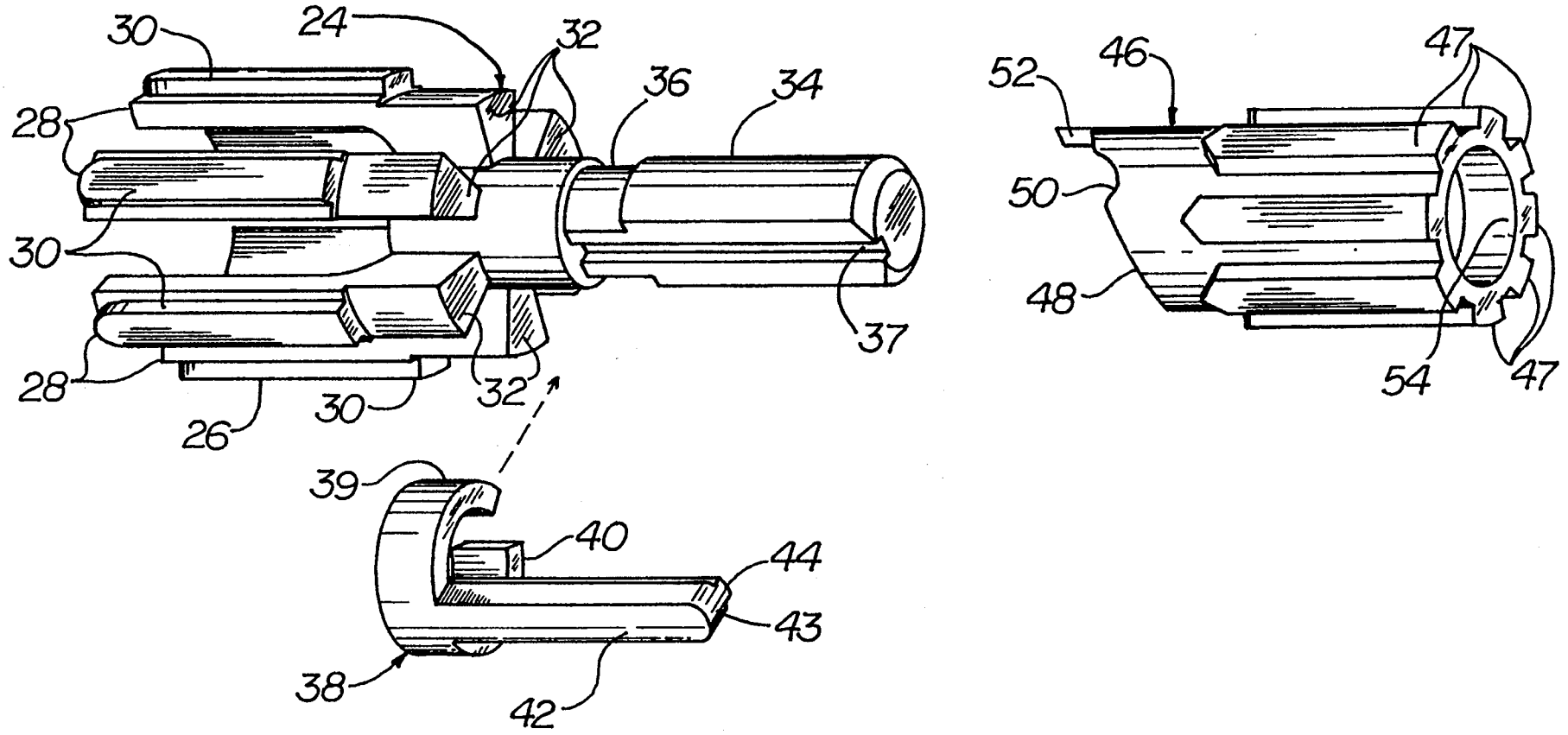
FIG. 5 is an exploded perspective view showing operative elements of the writing instrument of FIGS. 1 through 4.

As best shown in FIG. 5, the plunger assembly 24 comprises a rotatable knob 26 which in the present embodiment is formed of a plurality of rearwardly and outwardly extending legs 28. Each of the legs 28 has an outwardly protruding portion 30, and as shown in FIG. 1, a cover 31, which may be fabricated of metal material such as brass, stainless steel, etc., having openings in the same number as the protruding portions 30 is snapped over the legs for appearance purposes in the finished product.

Each of the legs 28 has a bearing surface 32 which serves to function in a manner which will be explained as the description proceeds.

The plunger assembly 24 further comprises an elongated drive portion 34 extending forwardly into the barrel 18, the drive portion having a circular groove 36 formed forwardly of the bearing surfaces 32. An axial keyway 37 is formed in the elongated drive portion 34 and terminates adjacent the rear surface of the groove 36.

Figure 4:
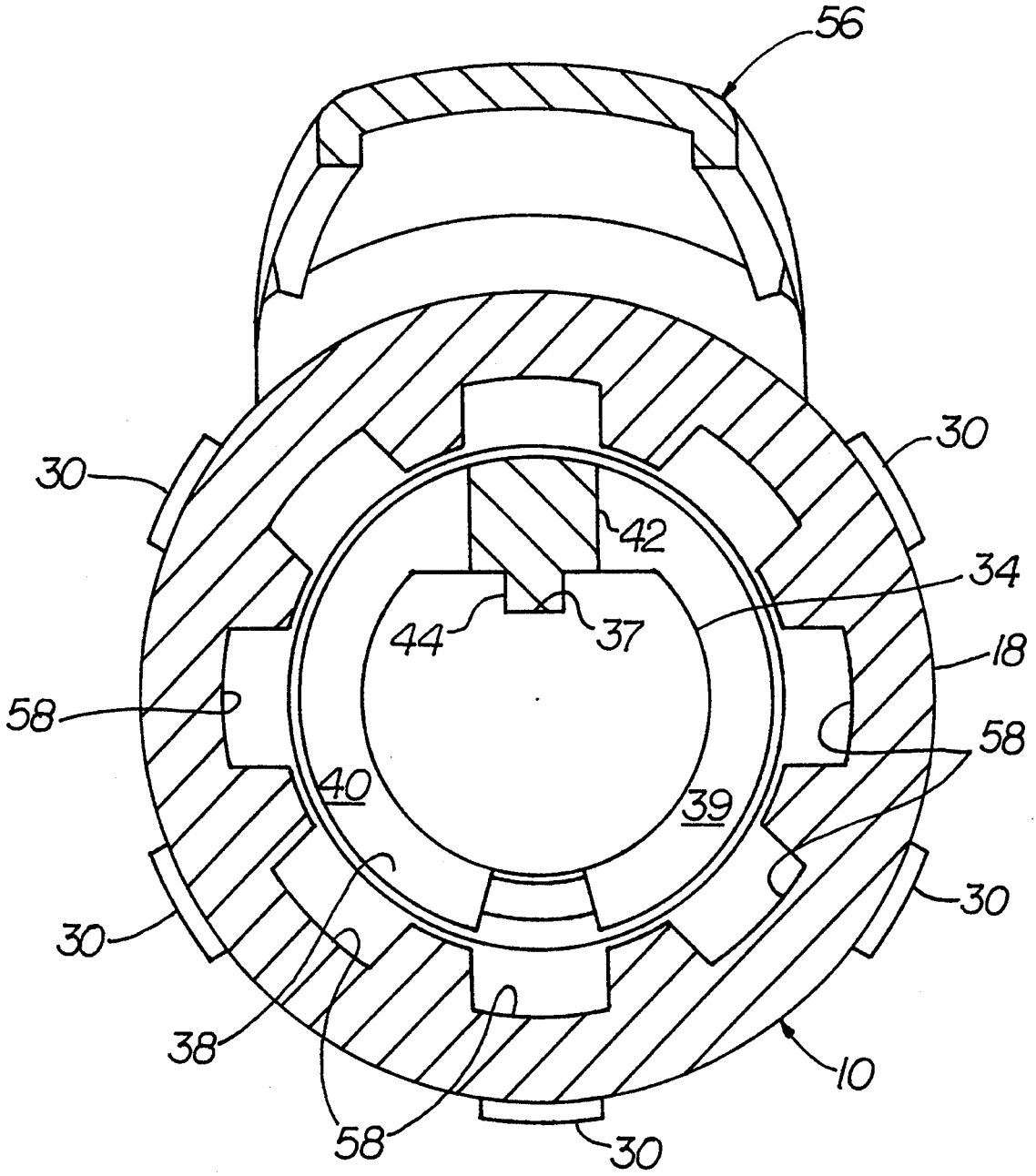
FIG. 4 is a sectional view taken along the line IV—IV of FIG. 1, taken on an enlarged scale showing further details of the elements of the structure of FIG. 1.

Referring to FIGS. 4 and 5, a ring 38 which is split to form a pair of substantially flexible arcuate portions 39 and 40 is dimensioned to be received in the circular groove in interfitting engagement. A longitudinally extending finger 42 comprises an arcuate forwardly facing surface 43 and a longitudinal inwardly projecting key 44 which is dimensioned to be received in the axial keyway 37 when the ring 38 is mounted onto the drive portion 34 of the plunger assembly.

Figure 3:
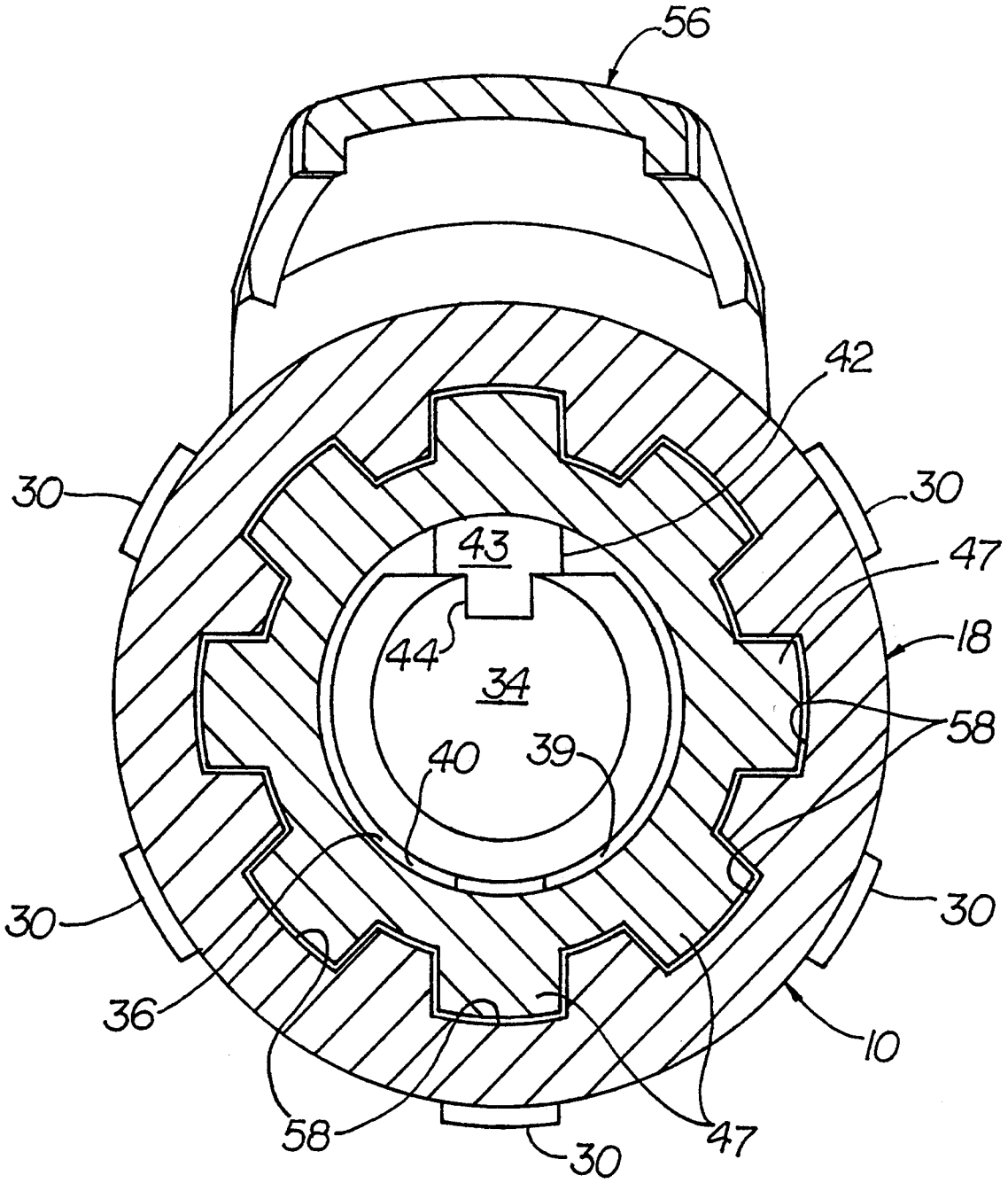
FIG. 3 is a sectional view taken along the line III—III of FIG. 1 on an enlarged scale, showing details of the elements of the structure of FIG. 1.

As best shown in FIGS. 1, 3 and 5 a slidable actuator 46 comprises an exterior cylindrical surface onto which is formed a plurality of axially disposed outwardly projecting slide bars 47 which in the present embodiment are eight in number. The bars 47 extend from the forward end of the actuator 46 rearwardly, terminating a short distance from the rear surface of the actuator. As best seen in FIG. 5, the rear surface of the actuator 46 is formed to produce a cam surface 48 which is disposed at a predetermined angle with respect to the longitudinal axis of the writing instrument 10. A notch 50 for receiving the arcuate surface 43 is formed in the cam surface 48 adjacent the rearwardmost portion of the actuator 46 and adjacent to a rearwardly extending stop 52. The actuator 46 further has a cavity 54 formed therein to receive the rearward projection of the writing assembly 12, the cavity being of any suitable dimension and configuration which will accommodate a particular writing assembly for which the writing instrument is adapted.

Referring now to FIGS. 1 through 4, assembly of the advance-retract portion of the writing instrument 10, which comprises the plunger assembly 24, ring 38 and actuator 46, is simply accomplished by inserting the drive portion 34 of the plunger assembly 24 through the opening 22 in the rear wall 20, prior to the rear portion of the barrel 18 being assembled to the forward portion at the screw threads 55. A clip 56 having a portion 57 with an opening formed therein will have been assembled between the knob 26 and the rear wall 20 by employment of a rivet 60, if a clip is to be desired in the final assembly.

The ring 38 is now inserted through the forward end of the barrel 18 rear portion, the key 44 rotated into alignment with the axial keyway 37, and the arcuate portions 39 and 40 are spread by the chamfer on drive portion 34 to allow the ring to ride over the drive portion 34 until the ring is received in the circular groove 36. The location of the rear surface of the groove 36 and the bearing surfaces 32 are dimensioned such that with the ring 38 mounted onto the drive portion 34 there is a clamping of the ring and knob members either with the clip portion 57 and wall 20 therebetween, if a clip 56 is employed, or merely with the wall between the two if a clip is not to be employed.

As best shown in FIGS. 3 and 4, a plurality of longitudinal grooves 58 are formed within the barrel 18 and the actuator 46 is entered into the barrel by aligning the slide bars 47 with the grooves 58 and moving the actuator rearwardly until the cam surface 48 contacts the arcuate surface 43 of the finger 42. The forward portion of the barrel 10 with the writing assembly 12 and helical spring 16 disposed therein is then assembled to the rear portion of the barrel 10 and the writing assembly rearwardmost extremity is received in the cavity 54 of the actuator 46. To complete the assembly the cap 31 is placed over the knob 24 with the outwardly protruding portions 30 fitting through slots in the cover 31 to retain the cover onto the knob.

It will be appreciated that the particular steps of the assembly procedure may vary somewhat from the above without departing from the spirit of the invention. For example, the ring 38 may first be inserted in the barrel 18 and the drive portion 34 then inserted through the opening 22 while the ring is held in place.

It should further be understood that although the longitudinal grooves 58 are shown herein as being formed in the structure of the barrel 18, a separate sleeve (not shown) embodying the grooves may be inserted in the barrel, the sleeve having the grooves formed and retained therein, which grooves function in the same manner as when formed in the barrel.

In operation, with the finger 42 disposed on the low or forwardmost part of the cam surface 48 the helical spring 16 forces the writing assembly 12 against the actuator 46 and the writing tip 13 is maintained within the barrel 18 of the writing instrument 10. Rotation of the knob 26 is effective through the axial keyway 37 and key 44 to rotate the arcuate surface 43 of the finger along the cam surface 48 moving the actuator forwardly into the barrel 18 with the subsequent forward movement of the writing assembly 12 until the tip 13 lies beyond the front opening in the barrel. The finger 42 is rotated until it reaches the stop 52 at which point the arcuate surface 43 of the finger 42 falls into the notch 50 and maintains the writing tip 13 in the writing position outside of the barrel 18. It should be evident that when the finger 42 is rotated with the arcuate surface 43 in contact with the cam surface 48, the motion would have a tendency to rotate the actuator 46, however, due to the slide bars 47 being retained in the longitudinal groove 58 the actuator is free to move in the longitudinal direction without rotation.

To retract the writing tip 13, the knob 26 is rotated in the opposite direction and the helical spring 16 forces the writing assembly 12 back into the barrel 18 as the arcuate surface 43 moves to the lower or forwardmost portion of the cam surface 48.

In operation of the present embodiment, as described above, the writing tip 13 is moved forwardly by rotation of the knob 26 in one direction until the finger 42 reaches the stop 52, and moved rearwardly by counter rotation of the knob. If desired however, the stop 52 may be deleted from the cam surface 48, in which instance the tip 13 will be advanced forwardly by rotation of the knob 26 until the arcuate surface of the finger 42 is received in the notch 50, and further rotation of the knob in the same direction will serve to cause rearward movement of the tip into the barrel 18.

It should also be understood that while in the preferred embodiment the cam surface 48 is shown to be formed on the actuator 46 and the finger 42 is disposed on the ring 38, the device may be constructed with the cam surface formed on the ring 38 and the finger disposed on the actuator 46 within the scope of the present invention.

From the forgoing it should be evident that the present invention provides a writing instrument 10 which contains an advance-retract mechanism having few parts, which are simple to manufacture and provide for ease of assembly. The writing instrument therefore is one which is economical in both material and labor cost providing an improvement over those writing instruments of the prior art.

While it is apparent that changes and modifications can be made within the spirit and scope of the present invention, it is my intention, however, only to be limited by the appended claims.

As my invention I claim:

1. A writing instrument comprising a cylindrical barrel member having a front opening and a rear wall with an opening formed therein an elongated writing assembly having a writing tip at the forward end thereof adjacent said front opening in said barrel;

a plunger assembly having a rotatable knob disposed adjacent the outer surface of said rear wall of said barrel and an elongated drive portion extending into said barrel, said elongated drive portion including a circular groove formed on the outer surface thereof;

a ring disposed on said elongated drive portion adjacent the inner surface of said rear wall and retained against axial movement along said drive portion, said ring having a forwardly facing surface rotatable through rotation of said rotatable knob and an inner surface formed for interfitting engagement within said drive portion groove;

a slidable actuator element disposed within said barrel having a forward facing surface contacting said writing assembly and a rearwardly facing surface contacting said ring rotatable surface whereby rotation of said knob is effective to move said actuator element axially and thereby move said writing tip axially relative to said barrel front opening.

2. A writing instrument as set forth in claim 1 wherein said actuator element rearwardly facing surface is a cam surface.

3. A writing instrument as set forth in claim 2 wherein said slidable actuator is provided with means for inhibiting rotation thereof with said slidable actuator in forward position and said writing tip disposed outside said barrel front opening.

4. A writing instrument as set forth in claim 3 wherein means for inhibiting rotation of said ring with said actuator in the forward position comprises a notch formed in said actuator cam surface.

5. A writing instrument as set forth in claim 2 wherein said rotatable knob has a forwardly facing surface disposed adjacent the barrel rear wall and said ring is provided with a rearwardly facing surface contacting said rear wall with said ring inner surface engaged in said groove, said knob forwardly facing surface and said ring rearwardly facing surface being spaced one from the other to inhibit axial movement of said knob and ring assembly with said ring inner surface engaged in said groove.

6. A writing instrument as set forth in claim 5 which further includes clip having one portion extending along said barrel and another portion extending over said barrel rear wall with said elongated drive portion extending through an opening formed therein.

7. A writing instrument as set forth in claim 6 wherein said elongated drive portion has an axially disposed keyway formed on the outer surface thereof and said forwardly extending finger has an inwardly projecting key surface formed thereon, said key surface being disposed in said keyway thereby to inhibit rotation of said finger relative to said elongated drive portion during rotation of said drive portion.

8. A writing instrument as set forth in claim 7 which further includes means for biasing said writing assembly and said actuator element in the rearward direction.

9. A writing instrument as set forth in claim 8 wherein said biasing means comprises a helical spring contacting said writing assembly and forcing said assembly rearwardly.

10. A writing instrument as set forth in claim 9 wherein said barrel has a plurality of axial grooves formed therein spaced about the barrel internal surface and wherein said slidable actuator is provided with a plurality of axially disposed outwardly projecting slide bars formed on the outer surface for mating slidable engagement with said axial grooves.

11. A writing instrument as set forth in claim 10 wherein said slidable actuator is provided with means for inhibiting rotation thereof with said slidable actuator in forward position and said writing tip disposed outside said barrel front opening.

12. A writing instrument as set forth in claim 11 wherein means for inhibiting rotation of said ring with said actuator in the forward position comprises a notch formed in said actuator cam surface.

13. A writing instrument as set forth in claim 1 wherein said ring is provided with a forwardly extending finger and said forwardly facing rotatable surface is disposed on said finger.

14. A writing instrument as set forth in claim 1 wherein said rotatable knob has a forwardly facing surface disposed adjacent the barrel rear wall and said ring is provided with a rearwardly facing surface contacting said rear wall with said ring inner surface engaged in said groove, said knob forwardly facing surface and said ring rearwardly facing surface being spaced one from the other to inhibit axial movement of said knob and ring assembly with said ring inner surface engaged in said groove.

15. A writing instrument as set forth in claim 14 which further includes clip having one portion extending along said barrel and another portion extending over said barrel rear wall with said elongated drive portion extending through an opening formed therein.

16. A writing instrument as set forth in claim 1 which further includes means for biasing said writing assembly and said actuator element in the rearward direction.

17. A writing instrument as set forth in claim 16 wherein said biasing means comprises a helical spring contacting said writing assembly and forcing said assembly rearwardly.

18. A writing instrument as set forth in claim 1 wherein said barrel has a plurality of axial grooves formed therein spaced about the barrel internal surface and wherein said slidable actuator is provided with a plurality of axially disposed outwardly projecting slide bars formed on the outer surface for mating slidable engagement with said axial grooves.

19. A writing instrument comprising a cylindrical barrel member having a front opening and a rear wall with an opening formed therein an elongated writing assembly having a writing tip at the forward end thereof adjacent said front opening in said barrel;

a plunger assembly having a rotatable knob disposed adjacent the outer surface of said rear wall of said barrel and an elongated drive portion extending into said barrel and having an axially disposed keyway formed on the outer surface thereof;

a ring disposed on said elongated drive portion adjacent the inner surface of said rear wall and retained against axial movement along said drive portion, said ring having a finger with a forwardly facing surface rotatable through rotation of said rotatable knob, said finger having an inwardly projecting key surface formed thereon, said key surface being disposed in said keyway thereby to inhibit rotation of said finger relative to said elongated drive portion during rotation of said drive portion;

a slidable actuator element disposed within said barrel having a forward facing surface contacting said writing assembly and a rearwardly facing surface contacting said ring rotatable surface whereby rotation of said knob is effective to move said actuator element axially and thereby move said writing tip axially relative to said barrel front opening.

20. A writing instrument as set forth in claim 19 wherein said actuator element rearwardly facing surface is a cam surface.

21. A writing instrument as set forth in claim 19 wherein said barrel has a plurality of axial grooves formed therein spaced about the barrel internal surface and wherein said slidable actuator is provided with a plurality of axially disposed outwardly projecting slide bars formed on the outer surface for mating slidable engagement with said axial grooves.

* * * * *